US006473575B2

(12) United States Patent
Okawa et al.

(10) Patent No.: US 6,473,575 B2
(45) Date of Patent: Oct. 29, 2002

(54) IMAGE FORMATION APPARATUS CAPABLE OF SETTING PLURAL-KIND MEDIA MODE FORMING SAME IMAGE ON PLURAL KINDS OF RECORDING MEDIA

(75) Inventors: Satoshi Okawa, Toride (JP); Kazuki Miyamoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/119,035

(22) Filed: Apr. 10, 2002

(65) Prior Publication Data

US 2002/0110382 A1 Aug. 15, 2002

Related U.S. Application Data

(62) Division of application No. 09/730,385, filed on Dec. 6, 2000, now Pat. No. 6,393,231.

(30) Foreign Application Priority Data

Dec. 9, 1999 (JP) ..... 11-350081

(51) Int. Cl.[7] ..... G03G 15/00
(52) U.S. Cl. ..... 399/81; 399/85
(58) Field of Search ..... 399/81, 85, 82, 399/380, 405, 364, 386

(56) References Cited

U.S. PATENT DOCUMENTS

| | | | | |
|---|---|---|---|---|
| 5,481,353 A | 1/1996 | Hicks et al. | 399/382 |
| 5,610,700 A | 3/1997 | Yoshizuka | 399/45 |
| 5,656,846 A | 8/1997 | Yoshioka | 399/85 |
| 5,809,392 A | 9/1998 | Tabuchi et al. | 399/405 |
| 6,393,231 B2 * | 5/2002 | Okawa et al. | 399/81 |

FOREIGN PATENT DOCUMENTS

| | | |
|---|---|---|
| JP | 5-257350 | 10/1993 |
| JP | 8-248711 | 9/1996 |
| JP | 10-143015 | 5/1998 |
| JP | 10-221908 | 8/1998 |

* cited by examiner

*Primary Examiner*—Quana M. Grainger
(74) *Attorney, Agent, or Firm*—Fitzpatrick, Cella, Harper & Scinto

(57) ABSTRACT

In a presentation mode, it is aimed to omit an extra setting procedure for setting for OHP and ordinary sheets and a change of the setting, and to provide an excellent presentation mode setting environment capable of starting the setting from any sheet. When a presentation mode is set, it is selected which of the OHP and ordinary sheets the setting input for image formation should be performed to, a setting screen for inputting image formation setting information according to the selected sheet is displayed by a CPU on a display unit, the setting information input from the setting screen is stored in a nonvolatile memory, and then the information being subjected to the setting input is stored in the nonvolatile memory and the setting screen is changed to a setting screen for other sheet by the CPU even if the setting information for any sheet is being input.

9 Claims, 9 Drawing Sheets

FIG. 10

STORAGE MEDIUM SUCH AS FD, CD-ROM, ETC.

| DIRECTORY INFORMATION |
| --- |
| 1ST DATA PROC PROGRAM<br>PROGRAM CODE GROUP CORRESPONDING TO STEPS IN FLOW CHARTS OF FIGS. 7—9 |
| |

IMAGE FORMATION APPARATUS CAPABLE OF SETTING PLURAL-KIND MEDIA MODE FORMING SAME IMAGE ON PLURAL KINDS OF RECORDING MEDIA

This application is a division of application Ser. No. 09/730,385, filed on Dec. 6, 2000 now U.S. Pat. No. 6,393,231.

BACKGROUND OF THE INVENTION

1. Field of the Invention

The present invention relates to an image formation apparatus which can set plural-kind media mode to form the same image on plural kinds of recording media, a control method for the image formation apparatus, and a storage medium which stores a program to execute the control method.

2. Related Background Art

Conventionally, a copying machine can perform copying on an ordinary (or common) sheet and also on a transparent sheet for an overhead projector (OHP) (hereinafter called an OHP sheet).

As such the copying machine, a copying machine which can set an OHP presentation mode has been proposed in Japanese Patent Application Laid-Open No. 8-248711. In this OHP presentation mode, on one hand an original image is copied onto the OHP sheet, and an inserting paper is affixed to the back face of the OHP sheet and the obtained sheet is then discharged, and on the other hand the original image is copied to the ordinary sheets of the necessary number as distribution copies (i.e., the copies to be distributed), and the copying sheets (i.e., the sheets subjected to the copying) are sorted and discharged by a sorter.

In the conventional copying machine having the above OHP presentation mode, when this mode is set, copy setting for the OHP sheet is first performed, and copy setting for the ordinary sheet as the distribution copying is then performed.

However, in such a setting procedure, after the copy setting for the OHP sheet ended, when it is intended to change or vary the copy setting for the OHP sheet while the copy setting for the ordinary sheet is being performed, it is necessary to once complete the copy setting for the ordinary sheet and then perform again the copy setting for the OHP sheet. In this case, it is necessary to again perform the copy setting for the ordinary sheet after the copy setting for the OHP sheet, whereby there is a problem that the operation is extremely troublesome.

Further, even when only the copy setting for the ordinary sheet is performed (i.e., only the copy setting for the ordinary sheet is intended to be changed), it is necessary to perform the copy setting for the ordinary sheet after the copy setting for the OHP sheet, whereby there is a problem that it takes extra time.

Similarly, even when only the copy setting for the OHP sheet is performed, there is a problem that it is necessary to further perform the copy setting for the ordinary sheet after such the copy setting for the OHP sheet.

SUMMARY OF THE INVENTION

An object of the present invention is to provide an image formation apparatus which solved the above problems, a control method for this image formation apparatus, and a storage medium which stores a program to execute this control method.

Concretely, the object of the present invention is to provide the image formation apparatus which improved operability in case of setting a disparate media mode to form the same image on plural different kinds of recording media, the control method for this image formation apparatus, and the storage medium which stores a program to execute this control method.

In order to achieve the above object, the present invention provides an image formation apparatus capable of setting a disparate media mode to form a same image on plural different kinds of recording media, comprising:

- a display for changeably displaying plural setting screens provided corresponding to the respective kinds of recording media, the setting screen being used to input setting information concerning the image formation on each recording medium;
- a terminal for inputting the setting information from each setting screen displayed on the display;
- a memory for storing the setting information input from the terminal; and
- a key for inputting an instruction to change the setting screen corresponding to one kind of recording medium to the setting screen corresponding to other kind of recording medium, when the disparate media mode is being set.

Other objects and features of the present invention will become apparent from the following detailed description and the attached drawings.

BRIEF DESCRIPTION OF THE DRAWINGS

FIG. 10 is a diagram for explaining a memory map of a storage medium in which various data process programs readable by the image formation apparatus according to the present invention.

DETAILED DESCRIPTION OF THE PREFERRED EMBODIMENTS

First Embodiment

Hereinafter, the embodiment of the present invention will be explained with reference to the attached drawings.

Figure 1:
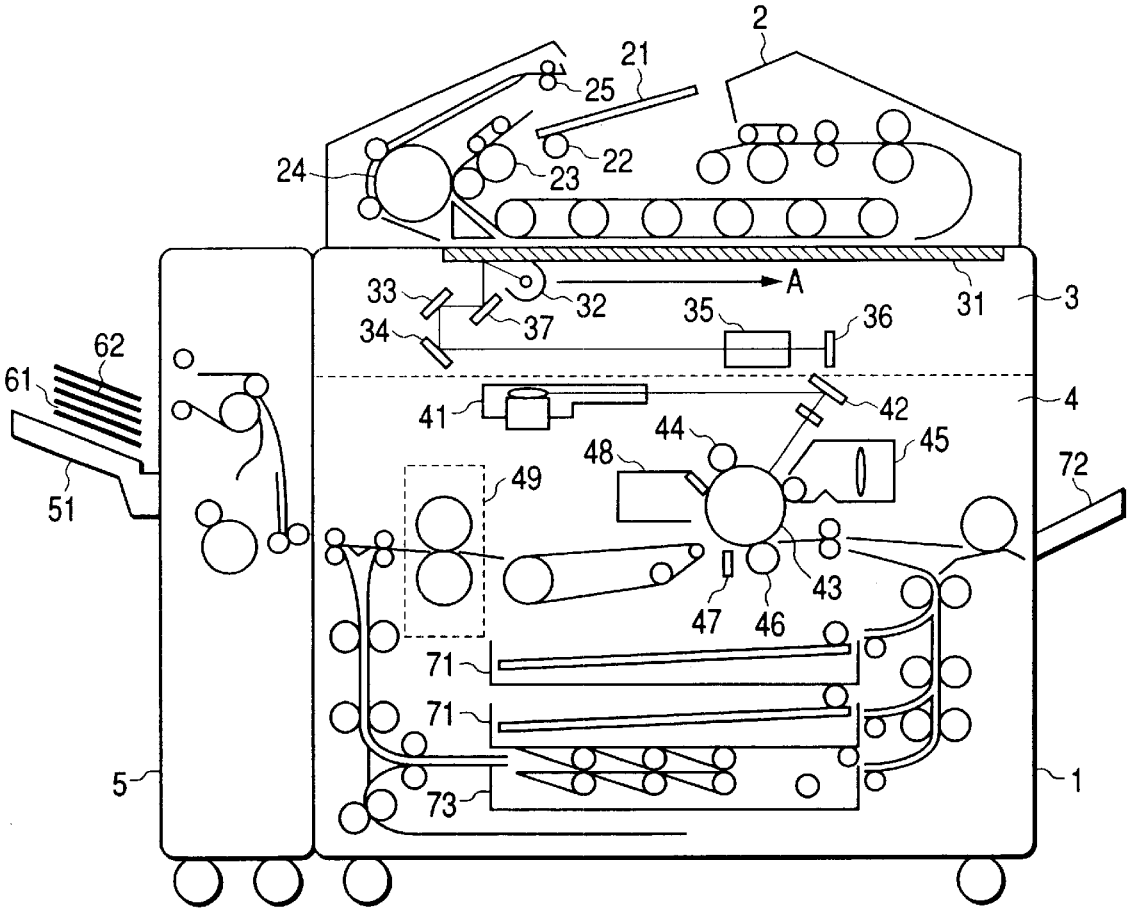
FIG. 1 is a sectional view showing the structure of a copying machine to which an image formation apparatus according to the first embodiment of the present invention is applicable.

FIG. 1 is a sectional view showing the structure of a copying machine to which an image formation apparatus according to the first embodiment of the present invention is applicable.

In FIG. 1, numeral 3 denotes an image reading unit which reads image data from an original set on an original glass 31, numeral 4 denotes an image formation unit which forms an image on a recording medium such as an ordinary (or common) sheet, an OHP sheet or the like on the basis of the image data read by the image reading unit 3, and numeral 5 denotes a sheet discharge process device which sorts the recording media on which the images were respectively formed by the image formation unit 4 and discharges the sorted recording media.

Figure 3:
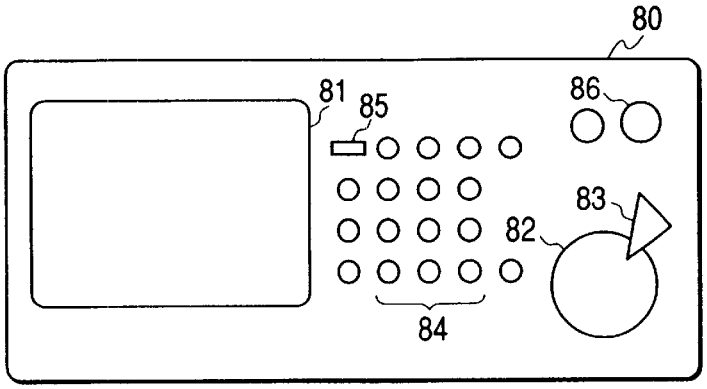
FIG. 3 is a plan view for explaining an operation unit of the digital copying machine shown in FIG. 2.

As shown in FIG. 1, the digital copying machine according to the present embodiment is composed of the image reading unit 3 installed at the upper part thereof, the image formation unit 4 installed at the middle part thereof, and the sheet discharge process device 5 installed at the sheet discharge part. Further, the digital copying machine includes an automatic document feeder (ADF) 2 thereon, sheet feed cassettes 71 at the internal middle part thereof for stacking recording sheets, a manual feed tray 72 for mainly feeding the OHP sheet, and a two-faced copying tray 73 at the internal lower part thereof for enabling to form images on the two (i.e., front and back) faces of the recording sheet. Further, as shown in FIG. 3, the digital copying machine includes an operation unit 80 by which a presentation mode is set.

The ADF 2 is the device which automatically supplies the original onto the original glass 31. In the ADF 2, numeral 21 denotes an original tray on which the original to be copied is located, numeral 22 denotes a sheet feed roller which is used to feed the original located on the original tray 21, numeral 23 denotes a carrying roller which is used to carry the original fed by the feed roller 22, numeral 24 denotes a reverse roller which is used to reverse the original when two-faced copying is performed, and numeral 25 denotes a sheet discharge roller which is used to discharge the original after the copying ended.

Thus, the ADF 2 includes the original tray 21, the sheet feed roller 22, a separation belt which is used to draw the original one by one, the carrying roller 23, a register roller which is used to carry one drawn original onto the original glass 31, the reverse roller 24, and the sheet discharge roller 25.

By the ADF 2, the original set on the original tray 21 is carried one by one onto the original glass 31, and discharged after the copying.

Next, in the image reading unit 3, numeral 32 denotes an exposure unit which is moved toward a direction indicated by an arrow A while irradiating the not-shown original set on the original glass 31 to scan the entirety of the original. Numeral 36 denotes a CCD image sensor (simply called a CCD hereinafter) which reads reflection light input from the original through a first mirror 37, a second mirror 33, a third mirror 34 and a lens 35 and outputs image data.

Next, the operation of the image reading unit 3 will be explained.

In the image reading unit 3, when the not-shown original is set on the original glass 31 and an instruction to start the copying is issued, the exposure unit 32 is moved toward the direction A while irradiating the original to scan it. The light irradiated by the exposure unit 32 is reflected on the original, guided by the second and third mirrors 33 and 34, passed through the lens 35, and read by the CCD 36. The read light is converted into the image data and recorded in an image memory.

Next, in the image formation unit 4, numeral 41 denotes a laser unit by which a laser beam based on the image data obtained by the CCD 36 is generated. In the image formation, the generated laser beam is irradiated through a laser mirror 42 onto a photosensitive drum 43 rotatively driven to form an electrostatic latent image on the drum 43.

Numeral 44 denotes a charging unit which electrifies the photosensitive drum 43, and numeral 45 denotes a development unit which develops the electrostatic latent image on the drum 43 with a development agent (or a recording agent) such as toner or the like. Numeral 46 denotes a transfer unit which transfers a development-agent image on the drum 43 to the recording medium supplied from the sheet feed cassette 71, the manual feed tray 72 or the two-faced copying tray 73. Numeral 47 denotes a separation unit which separates the recording medium from the drum 43, numeral 48 denotes a cleaning unit which cleans and eliminates the residual recording agent on the drum 43, and numeral 49 denotes a fixing unit which fixes the transferred development-agent image to the recording medium.

As above, the image formation unit 4 includes the photosensitive drum 43, the laser unit 41, and further includes the charging unit 44, the development unit 45, the transfer unit 46, the separation unit 47, the cleaning unit 48 and the fixing unit 49 which are arranged around the drum 43 in due order along the rotation direction.

Hereinafter, the operation of the image formation unit 4 will be explained.

The surface of the photosensitive drum 43 is uniformly electrified by the charging unit 44, and the laser beam generated by the laser unit 41 is deflected by the laser mirror 42 and then irradiated on the drum 43. Thus, the electrostatic latent image corresponding to the original image read by the image reading unit 3 is formed on the surface of the photosensitive drum 43.

The obtained electrostatic latent image is developed by the development unit 45, and thus obtained development-agent image is transferred by the transfer unit 46 to the sheet fed from the sheet feed cassette 71, the manual feed tray 72 or the two-faced copying tray 73.

The residual development agent on the surface of the photosensitive drum after the developed image was transferred is eliminated by the cleaning unit 48, and the sheet on which the image was transferred is separated from the photosensitive drum 43 by the separation unit 47. After then, the sheet is carried to the fixing unit 49 to fix the development agent to the sheet. The sheet after the fixing is carried to the sheet discharge unit.

When the image is copied onto the two faces of the sheet, the sheet is carried to the two-faced copying tray 73 after the fixing, reversed on the tray 73, and again fed to the image formation unit 4. Thus, the image is formed on the back face of the sheet.

A sorter, a finisher or the like is used as the sheet discharge process device 5. In the sheet discharge process device 5, first and second kinds of sheets on which the original images were respectively formed are sorted and discharged to sheet discharge trays (sort bins, stack tray and the like). In the present embodiment, as shown in FIG. 1, it is assumed to use the finisher.

In the sheet discharge process device 5, numeral 51 denotes a sheet discharge tray on which discharged sheets 61 and 62 are stacked.

In the digital copying machine according to the present embodiment, it is possible to perform the copying onto the ordinary sheet being the second kind of sheet generally used as a copying sheet, and further it is possible to perform the copying onto the OHP sheet being the first kind of sheet. When the copying is performed onto the OHP sheet, this OHP sheet is supplied from the manual feed tray 72.

Figure 2:
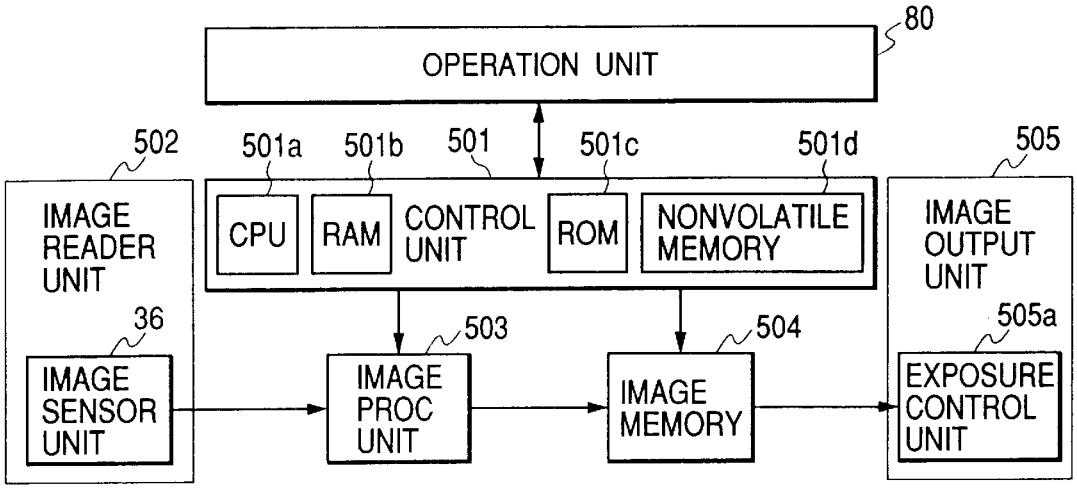
FIG. 2 is a block diagram for explaining the control. structure of the digital copying machine shown in FIG. 1.

FIG. 2 is a block diagram for explaining the control structure of the digital copying machine shown in FIG. 1.

In FIG. 2, numeral 80 denotes the operation unit which is controlled by a control unit 501. The operation unit 80 includes a user's information input unit such as a key, a button or the like, and a user's information output unit such as an LCD (liquid crystal display) or the like. In the present embodiment, the operation unit 80 functions as an interface between a user and the control unit 501. It should be noted that setting information input from the operation unit 80 is always stored in a RAM 501*b*. Numeral 502 denotes an image reader unit 502 which reads the original image.

Numeral 503 denotes an image processing unit which adjusts the image data digitized by the CCD 36 and performs various corrections so as to generate the image data faithful to the original and achieve high-quality image reproduction. Further, the image processing unit 503 has an editing and processing function which is necessary to convert the image data into the user's desired output. Numeral 504 denotes an image memory which stores the image data processed by the image processing unit 503, numeral 505 denotes an image output unit which reads the image data stored in the image memory 504 and forms the image according to the read image data on the recording sheet, and numeral 505*a* denotes an exposure control unit which controls the generation of the light signal from the laser unit 41 on the basis of the image data stored in the image memory 504.

The control unit 501 which entirely controls the digital copying machine is realized by a microcomputer composed of an information processing unit such as a CPU 501*a* and the like, an information storage unit such as the RAM 501*b*, a ROM 501*c*, a rewritable nonvolatile memory 501*d* (e.g., a hard disk drive (HDD), a flash memory or the like), and the like. Further, the control unit 501 controls the input operation at the operation unit 80, the message output from the operation unit 80, the original image reading by the CCD 36, the image processing flow by the image processing unit 503, the image data storage in the image memory 504, the image data reading from the image memory 504, the image data copying operation by the image output unit 505, the original feed operation by the ADF 2, and the copying sheet sorting and discharge operation by the sheet discharge process device (sorter unit) 5.

Further, if arbitrary copying process setting (user mode setting) from the operation unit 80 is previously stored in the information storage unit (the nonvolatile memory 501*d*, the RAM 501*b* or the like) of the control unit 501, it is possible to improve user's working efficiency when the user selects such the setting with a one-touch key.

FIG. 3 is the plan view for explaining the structure of the operation unit of the digital copying machine shown in FIG. 2. The presentation mode can be set from this operation unit.

In FIG. 3, numeral 81 denotes liquid crystal touch panel which is composed of an information display section including a liquid crystal element and the like and a detection section for detecting user's depression. The liquid crystal touch panel 81 is controlled by the control unit 501 shown in FIG. 2. By directly depressing the button or key displayed on the touch panel 81, detection information of such the depression is transferred to the control unit 501, whereby the function or option corresponding to the depressed button or key is selected.

Numeral 82 denotes a copy start key which is depressed to start the copying process or the like, numeral 83 denotes a stop key which is depressed to stop the operation of the copying process or the like, numeral 84 denotes ten keys which are depressed to input numerical information such as the number of copies or the like, and numeral 85 denotes a reset key which is depressed to reset the setting of the copying process or the like to its initial state.

Numeral 86 denotes a presentation mode key which is depressed to change a mode to the presentation mode. The setting input on the operation unit 80 is stored in the RAM 501*b*, the nonvolatile memory 501*d* or the like shown in FIG. 2.

Figure 4A:
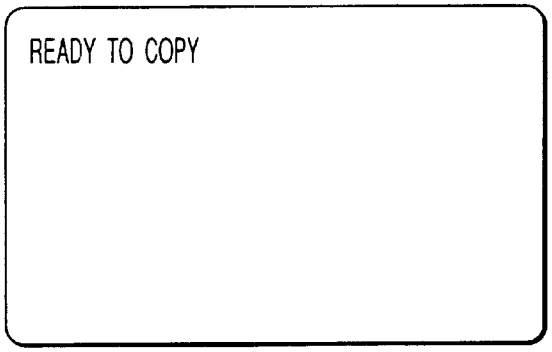
FIGS. 4A, 4B and 4C are diagrams showing setting screens displayed on a touch panel of FIG. 3 when a presentation mode is set.
Figure 4B:
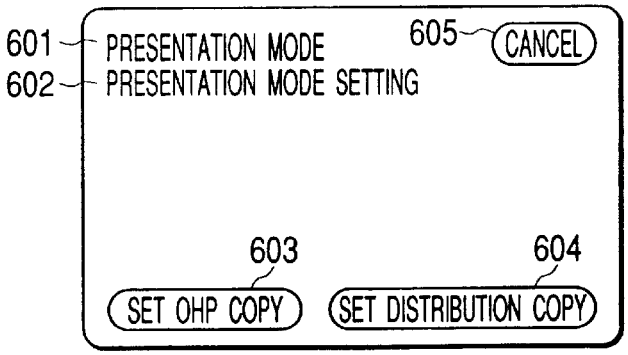
Figure 4C:
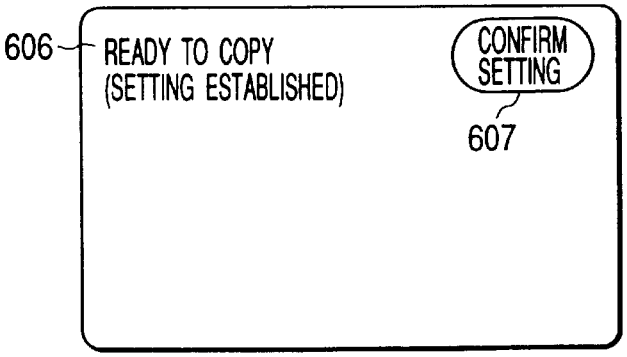

FIGS. 4A, 4B and 4C are diagrams showing setting screens displayed on the touch panel 81 of FIG. 3 when the presentation mode is set.

Namely, FIG. 4A shows an ordinary copying standby screen, FIG. 4B shows a presentation mode setting screen, and FIG. 4C shows a copying standby screen in the presentation mode.

In FIG. 4B, numeral 601 denotes a "PRESENTATION MODE" message which is displayed when the presentation mode key 86 is depressed to notify the user that the mode has been changed to the presentation mode.

Numeral 602 denotes a "PRESENTATION MODE SETTING" message which notifies the user that the screen has been changed to the presentation mode setting screen.

Figure 5A:
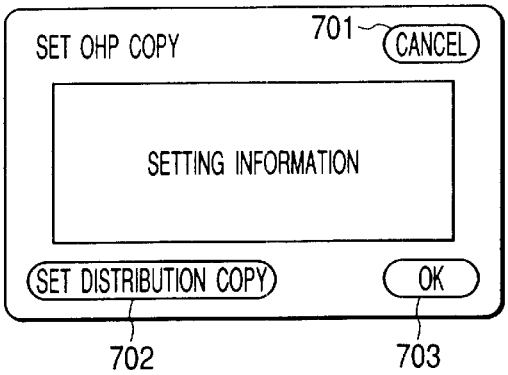
FIGS. 5A, 5B, 5C, 5D and 5E are diagrams showing setting screens displayed on the touch panel of FIG. 3 in an OHP copy setting mode.

Numeral 603 denotes an OHP copy setting key which is depressed to change the mode to the OHP copy setting mode. Thus, an OHP copy setting screen shown in later-described FIG. 5A is displayed, whereby the copy setting to the OHP sheet can be performed.

Figure 6A:
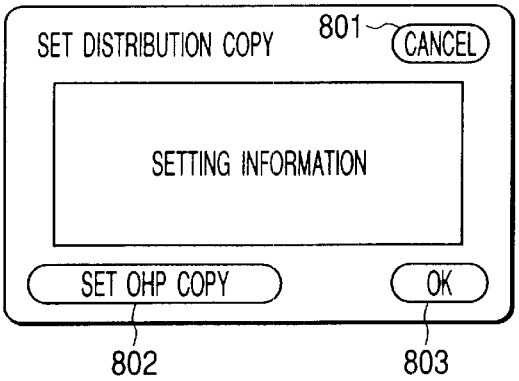
FIGS. 6A, 6B, 6C, 6D, 6E and 6F are diagrams showing setting screens displayed on the touch panel of FIG. 3 in a distribution copy setting mode.

Numeral 604 denotes a distribution copy setting key which is depressed to change the mode to the distribution copy setting mode. Thus, a distribution copy setting screen shown in later-described FIG. 6A is displayed, whereby the copy setting to the ordinary sheet can be performed.

Numeral 605 denotes a cancel key which is depressed to return to the ordinary copying standby screen shown in FIG. 4A.

In FIG. 4C, numeral 606 denotes a "READY TO COPY (SETTING ESTABLISHED)" message which notifies the user that both the OHP copy setting and the distribution copy setting have already ended.

Numeral 607 denotes a setting confirmation key. When the setting confirmation key 607 is depressed, the presentation mode setting screen shown in FIG. 4B is displayed, whereby the setting of the presentation mode can be confirmed and reset.

Figure 5D:
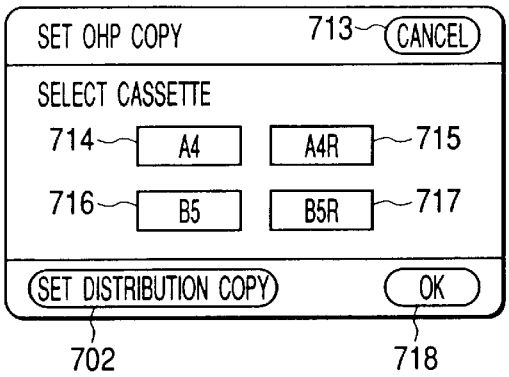
Figure 5B:
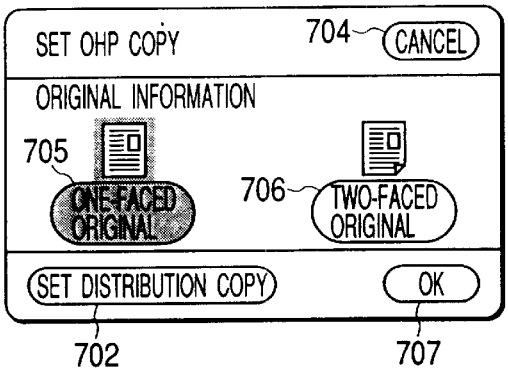
Figure 5E:
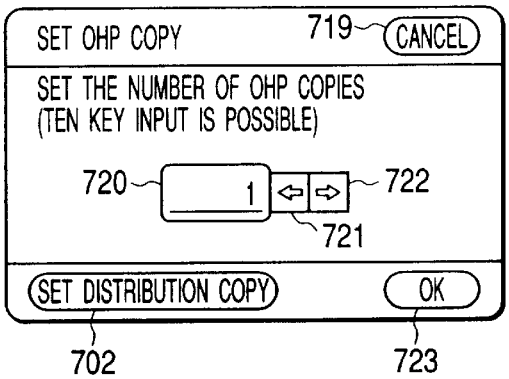
Figure 5C:
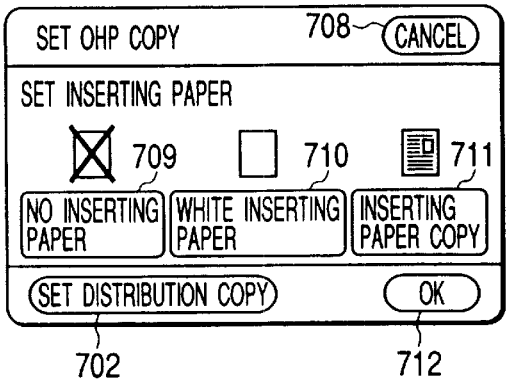

FIGS. 5A, 5B, 5C, 5D and 5E are diagrams showing setting screens displayed on the touch panel 81 in the OHP copy setting mode. Namely, FIG. 5A shows the OHP copy setting screen, FIG. 5B shows an original information setting screen, FIG. 5C shows an inserting paper setting screen, FIG. 5D shows a sheet feed cassette selection screen, and FIG. 5E shows an OHP copy number setting screen. As described above, the screen shown in FIG. 5A is displayed according as the OHP copy setting key 603 is depressed on the screen shown in FIG. 4B.

In FIG. 5A, numeral 701 denotes a cancel key which is depressed to return to the presentation mode setting screen shown in FIG. 4B. Numeral 702 denotes a distribution copy setting key which is depressed to change the mode to the distribution copy setting mode, whereby the distribution copy setting screen shown in later-described FIG. 6A is displayed. Numeral 703 denotes an OK key which is depressed to make the setting on the displayed screen effective. Thus, the screen advances to the original information setting screen shown in FIG. 5B. To make the setting on the displayed screen effective represents that the setting information is stored in the RAM 501*b*, and the process is performed based on the stored setting information as long as there is no change.

In FIG. 5B, numeral 704 denotes a cancel key which is depressed to cancel this screen and return to the OHP copy setting screen shown in FIG. 5A. Numeral 705 denotes a one-faced original key which is depressed when the copying process of a one-faced original is performed, numeral 706 denotes a two-faced original key which is depressed when the copying process of a two-faced original is performed. It should be noted that the one-faced original key 705 and the two-faced original key 706 can be exclusively selected. Numeral 707 denotes an OK key which is depressed to make the setting on the displayed screen effective. Thus, the screen advances to the inserting paper setting screen shown in FIG. 5C.

In FIG. 5C, numeral 708 denotes a cancel key which is depressed to cancel this screen and return to the original information setting screen shown in FIG. 5B. Numeral 709 denotes a no inserting paper key which is depressed not to insert an inserting paper between the OHP sheets, numeral 710 denotes a white inserting paper key which is depressed to insert a white (blank) inserting paper between the OHP sheets, and numeral 711 denotes an inserting paper copy key which is depressed to insert an inserting paper on which the original was copied between the OHP sheets. It should be noted that the no inserting paper key 709, the white inserting paper key 710 and the inserting paper copy key 711 can be exclusively selected. Numeral 712 denotes an OK key which is depressed to make the setting on the displayed screen effective. Thus, the screen advances to the sheet feed cassette selection screen shown in FIG. 5D.

In FIG. 5D, numeral 713 denotes a cancel key which is depressed to cancel this screen and return to the inserting paper setting screen shown in FIG. 5C. Numeral 714 denotes an A4 key which is depressed to select an A4 cassette as the inserting paper, numeral 715 denotes an A4R key which is depressed to select an A4R cassette as the inserting paper, numeral 716 denotes a B5 key which is depressed to select a B5 cassette as the inserting paper, and numeral 717 denotes a B5R key which is depressed to select a B5R cassette as the inserting paper. It should be noted that the A4 key 714, the A4R key 715, the B5 key 716 and the B5R key 717 can be exclusively selected. Numeral 718 denotes an OK key which is depressed to make the setting on the displayed screen effective. Thus, the screen advances to the OHP copy number setting screen shown in FIG. 5E.

In FIG. 5E, numeral 719 denotes a cancel key which is depressed to cancel this screen and return to the sheet feed cassette selection screen shown in FIG. 5D. Numeral 720 denotes an OHP copy number display column on which the set number of OHP copies is displayed, numeral 721 denotes an OHP copy number increment key which is depressed to increase one by one the number of OHP copies displayed on the OHP copy number display column 720, numeral 722 denotes an OHP copy number decrement key which is depressed to decrease one by one the number of OHP copies displayed on the OHP copy number display column 720, and numeral 723 denotes an OK key which is depressed to make the setting on the displayed screen effective. Thus, when the distribution copy setting has been performed, the screen advances to the presentation mode setting establishment screen shown in FIG. 4C. On the other hand, when the distribution copy setting is not performed yet, the screen advances to the presentation mode setting screen shown in FIG. 4D. Since the copying to the OHP sheet is generally performed to produce one copy, the initial setting of the number of OHP copies displayed on the OHP copy number display column 720 is given to be "1".

Further, since the distribution copy setting key 702 is displayed on all the setting screens shown in FIGS. 5A to 5E, it is possible by depressing the key 702 to enter the distribution copy setting mode while maintaining the distribution copy setting information.

As explained above, the OK key, the cancel key and the distribution copy setting key are always displayed on every setting screen. Thus, the screen is changed to the next setting screen by depressing the OK key, the screen is changed to one-previous setting screen by depressing the cancel key, and the mode is changed to the distribution copy setting mode by depressing the distribution copy setting key.

Figure 6D:
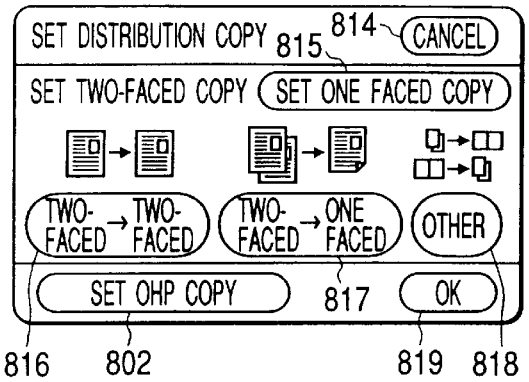
Figure 6B:
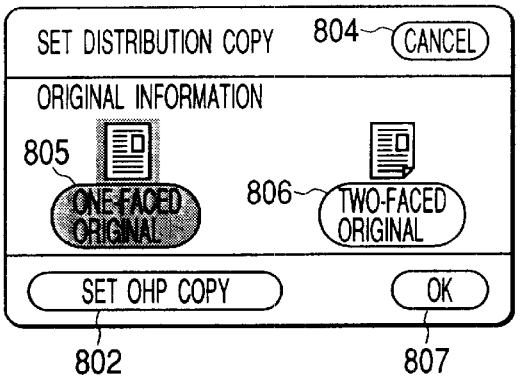
Figure 6E:
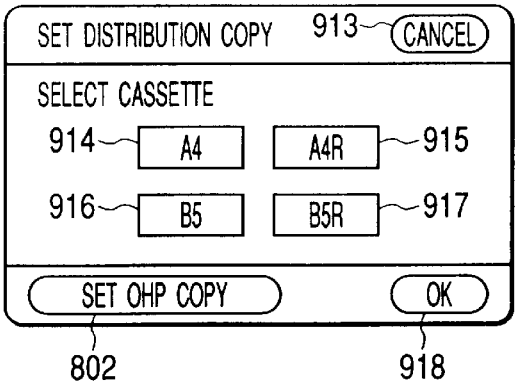
Figure 6C:
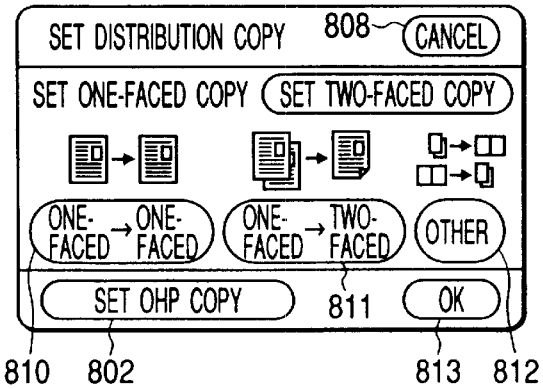

FIGS. 6A, 6B, 6C and 6D are diagrams respectively showing the setting screens displayed on the touch panel 81 in the distribution copy setting mode. Namely, FIG. 6A shows the distribution copy setting screen, FIG. 6B shows the original information setting screen, FIG. 6C shows the one-faced copy setting screen, and FIG. 6D shows the two-faced copy setting screen. As described above, the screen shown in FIG. 6A is displayed according as the distribution copy setting key 604 is depressed on the screen shown in FIG. 4B.

In FIG. 6A, numeral 801 denotes a cancel key which is depressed to return to the presentation mode setting screen shown in FIG. 4B. Numeral 802 denotes an OHP copy setting key which is depressed to change the mode to the OHP copy setting mode, whereby the OHP copy setting screen shown in FIG. 5A is displayed. Numeral 803 denotes an OK key which is depressed to make the setting on the displayed screen effective. Thus, the screen advances to the original information setting screen shown in FIG. 6B.

In FIG. 6B, numeral 804 denotes a cancel key which is depressed to cancel this screen and return to the distribution copy setting screen shown in FIG. 6A. Numeral 805 denotes a one-faced original key which is depressed when the copying process of an one-faced original is performed, numeral 806 denotes a two-faced original key which is depressed when the copying process of a two-faced original is performed. It should be noted that the one-faced original key 805 and the two-faced original key 806 can be exclusively selected. Numeral 807 denotes an OK key which is depressed to advance to the one-faced copy setting screen shown in FIG. 6C when the one-faced original key 805 is being selected, and advance to the two-faced copy setting screen shown in FIG. 6D when the two-faced original key 806 is being selected.

In FIG. 6C, numeral 808 denotes a cancel key which is depressed to cancel the setting of this screen and return to the original information setting screen shown in FIG. 6B. Numeral 809 denotes a two-faced copy setting key which is depressed to advance to the two-faced copy setting screen shown in FIG. 6D, numeral 810 denotes a one-faced original to one-faced copy key which is depressed to copy an one-faced original onto one face of the distribution sheet, numeral 811 denotes a one-faced original to two-faced copy key which is depressed to copy an one-faced original onto two faces (i.e., front and back faces) of the distribution sheet, and numeral 812 denotes an other copy key which is depressed in a case other than the case of the one-faced original to the one-faced copy and the case of the one-faced original to the two-faced copy. For example, the other copy key 812 is depressed in a case where two one-faced originals are copied onto one distribution sheet (2-in-1 copy), a case where a double-spread original is copied onto two distribution sheets, or the like. It should be noted that the one-faced original to one-faced copy key 810, the one-faced original to two-faced copy key 811, and the other copy key 812 can be exclusively selected. Numeral 813 denotes an OK key which is depressed to make the setting on the displayed screen effective. Thus, the screen advances to a sheet feed cassette selection screen shown in FIG. 6E.

In FIG. 6D, numeral 814 denotes a cancel key which is depressed to cancel the setting of this screen and return to the original information setting screen shown in FIG. 6B. Numeral 815 denotes a one-faced copy setting key which is depressed to advance to the one-faced copy setting screen shown in FIG. 6C, numeral 816 denotes a two-faced original to two-faced copy key which is depressed to copy a two-faced original onto two faces of the distribution sheet, numeral 817 denotes a two-faced original to one-faced copy key which is depressed to copy a two-faced original onto each one face of the two distribution sheets, and numeral 818 denotes an other copy key which is depressed in a case other than the case of the two-faced original to the two-faced copy and the case of the two-faced original to the one-faced copy. For example, the other copy key 818 is depressed in a case where a two-faced original is copied onto one distribution sheet (2-in-1 copy), or the like. It should be noted that the two-faced original to two-faced copy key 816, the two-faced original to one-faced copy key 817, and the other copy key 818 can be exclusively selected. Numeral 819 denotes an OK key which is depressed to make the setting on the displayed screen effective. Thus, the screen advances to the sheet feed cassette selection screen shown in FIG. 6E.

In FIG. 6E, numeral 913 denotes a cancel key which is depressed to cancel this screen and return to the setting screen shown in FIG. 6C or 6D. Numeral 914 denotes an A4 key which is depressed to select an A4 cassette as the inserting paper, numeral 915 denotes an A4R key which is depressed to select an A4R cassette as the inserting paper, numeral 916 denotes a B5 key which is depressed to select a B5 cassette as the inserting paper, and numeral 917 denotes a B5R key which is depressed to select a B5R cassette as the inserting paper. It should be noted that the A4 key 914, the A4R key 915, the B5 key 916 and the B5R key 917 can be exclusively selected. Numeral 918 denotes an OK key which is depressed to make the setting on the displayed screen effective. Thus, the screen advances to an OHP copy number setting screen shown in FIG. 6F.

Figure 6F:
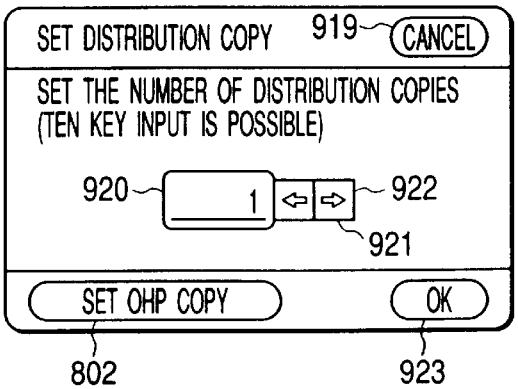

In FIG. 6F, numeral 919 denotes a cancel key which is depressed to cancel this screen and return to the sheet feed cassette selection screen shown in FIG. 6E. Numeral 920 denotes an OHP copy number display column on which the set number of OHP copies is displayed, numeral 921 denotes an OHP copy number increment key which is depressed to increase one by one the number of OHP copies displayed on the OHP copy number display column 920, numeral 922 denotes an OHP copy number decrement key which is depressed to decrease one by one the number of OHP copies displayed on the OHP copy number display column 920, and numeral 923 denotes an OK key which is depressed to make the setting on the displayed screen effective. Thus, when the distribution copy setting has been performed, the screen advances to the presentation mode setting establishment screen shown in FIG. 4C. On the other hand, when the distribution copy setting is not performed yet, the screen advances to the presentation mode setting screen shown in FIG. 4B.

Further, since the OHP copy setting key 802 is displayed on all the setting screens shown in FIGS. 6A to 5F, it is possible by depressing the key 802 to enter the OHP copy setting mode while maintaining the distribution copy setting information.

As explained above, the OK key, the cancel key and the OHP copy setting key are always displayed on every setting screen. Thus, the screen is changed to the next setting screen by depressing the OK key, the screen is changed to one-previous setting screen by depressing the cancel key, and the mode is changed to the OHP copy setting mode by depressing the OHP copy setting key.

Hereinafter, an operation (a process flow) in the case where the presentation mode of the image formation apparatus according to the present invention is being set will be explained with reference to FIGS. 7, 8 and 9.

Figure 7:
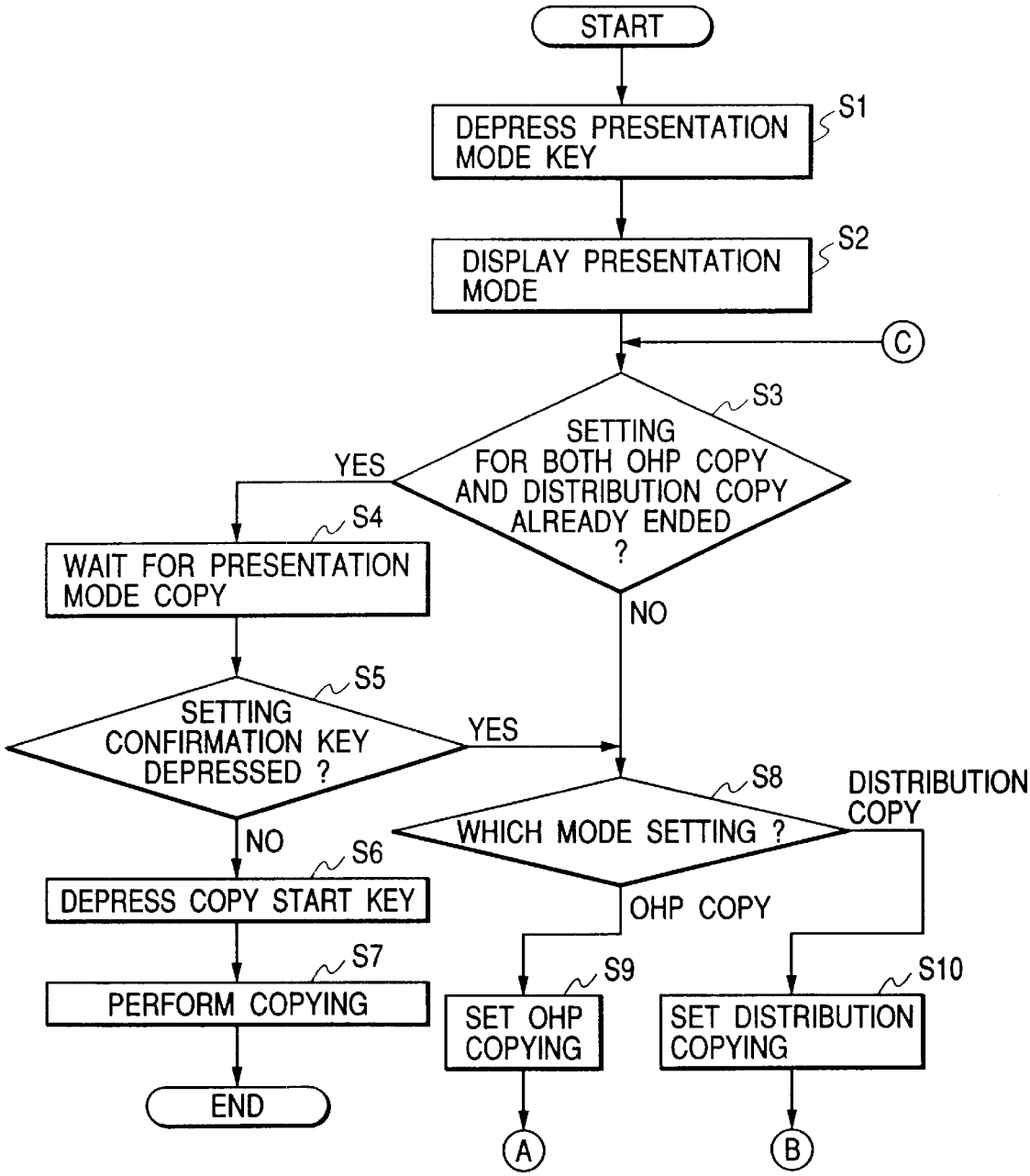
FIG. 7 is a flow chart showing a first control process procedure of the image formation apparatus according to the present invention.
Figure 8:
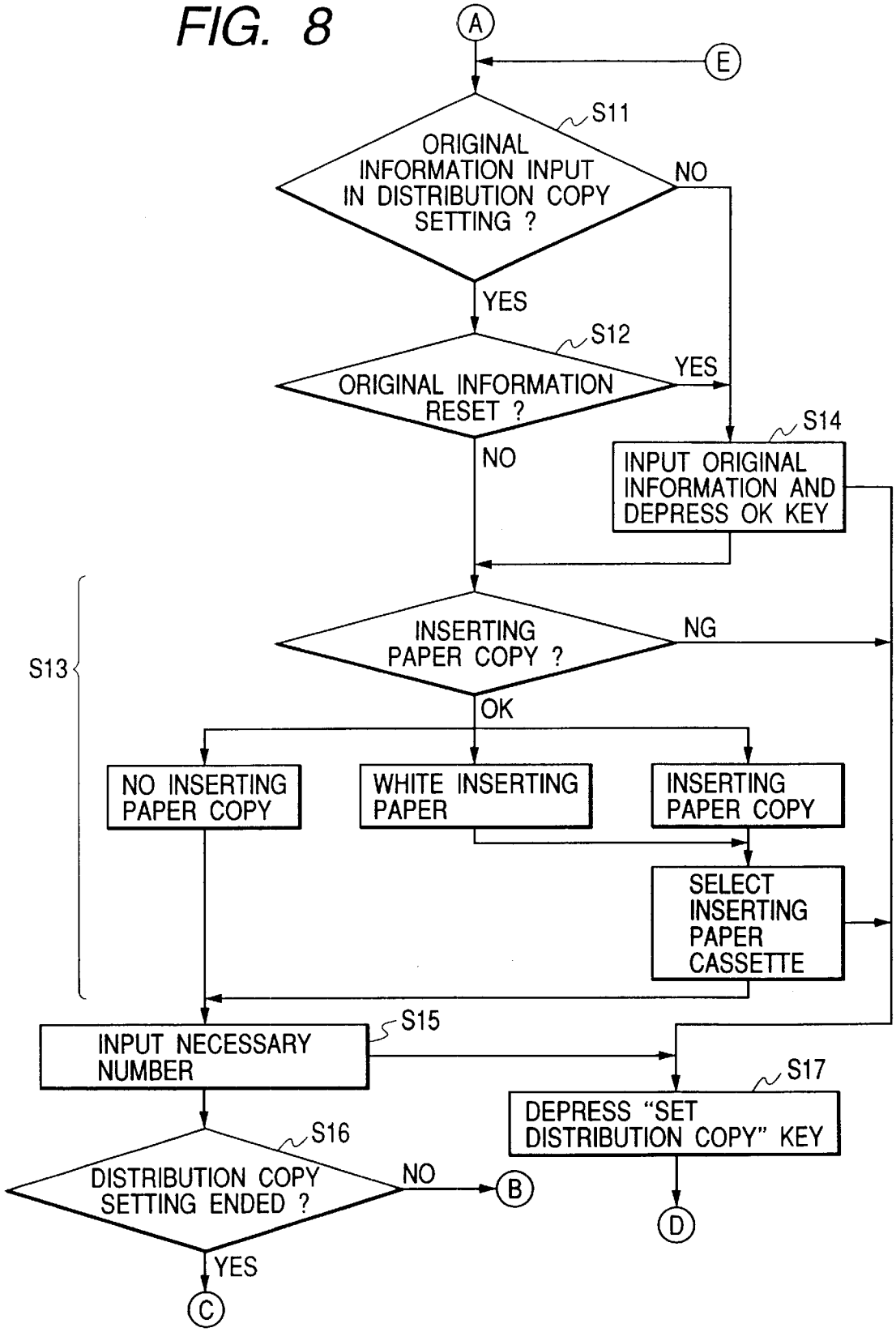
FIG. 8 is a flow chart showing the first control process procedure of the image formation apparatus according to the present invention.
Figure 9:
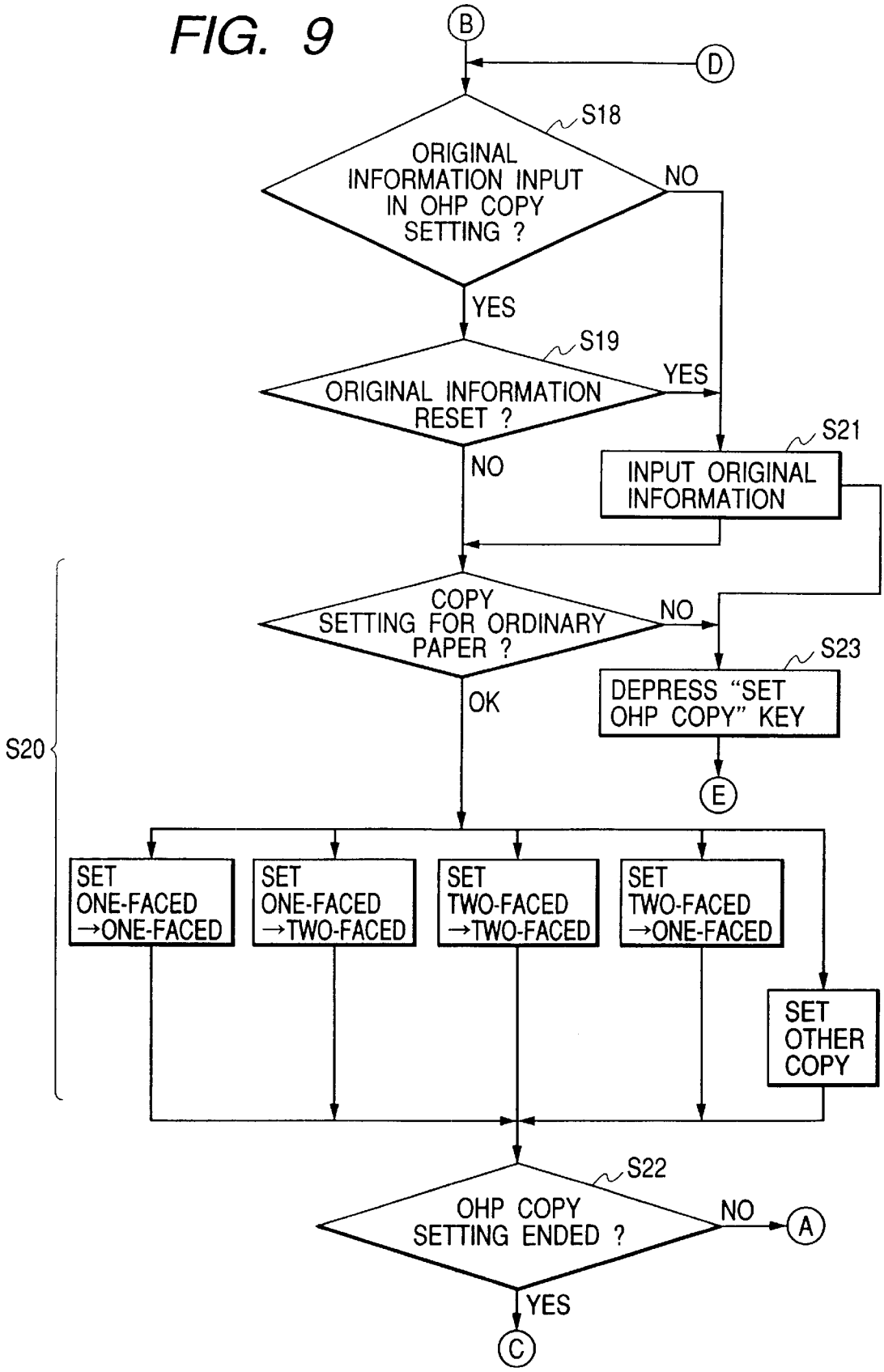
FIG. 9 is a flow chart showing the first control process procedure of the image formation apparatus according to the present invention.

FIGS. 7 to 9 are the flow chart showing a first control process procedure of the image formation apparatus according to the present invention. Concretely, FIG. 7 corresponds to the operation in the case where the presentation mode is being set, FIG. 8 corresponds to the operation in the OHP copy setting mode, and FIG. 9 corresponds to the operation in the distribution copy setting mode. It should be noted that the processes shown in FIGS. 7 to 9 are performed by the CPU 501*a* on the basis of the program stored in the ROM 501*c*, and that symbols S1 to S22 shows steps respectively.

First, in the case where the ordinary copying standby screen shown in FIG. 4A is displayed, when the presentation mode key 86 shown in FIG. 3 is depressed (S1), the displayed screen is changed to the presentation mode display screen. Thus, the "PRESENTATION MODE" message 601 shown in FIG. 4B is displayed on the touch panel 81 (S2).

Next, it is judged whether or not both the OHP copy setting and the distribution copy setting already ended (S3). For example, in such a case where the presentation mode key is depressed for the first time, if judged that both the OHP copy setting and the distribution copy setting do not end yet, the "PRESENTATION MODE SETTING" message shown in FIG. 4B is displayed on the touch panel 81. Further, the option of the OHP copy setting key 603 and the distribution copy setting key 604 and the cancel key 605 are displayed, and it is judged which of the OHP copy setting key 603 and the distribution copy setting key 604 is selected (S8).

If judged in the step S8 that the OHP copy setting key 603 is selected, the mode is changed to the OHP copy setting mode to perform the copy setting to the OHP sheet (S9), and the flow advances to the step S11 in FIG. 8. Conversely, if judged in the step S8 that the distribution copy setting key 604 is selected, the mode is changed to the distribution copy setting mode to perform the copy setting to the ordinary sheet (S10), and the flow advances to the step S18 in FIG. 9. It should be noted that the OHP copy setting in the step S9 is as having already explained with reference to FIGS. 5A to 5E, and the distribution copy setting in the step S10 is as having already explained with reference to FIGS. 6A to 6F.

On the other hand, if judged in the step S3 that the presentation mode has already been set once (both the OHP copy setting and the distribution copy setting already ended), as shown in FIG. 4C, the "READY TO COPY (SETTING ESTABLISHED)" message 606 and the setting confirmation key 607 are displayed on the touch panel 81 (S4). This screen is the copy standby screen.

Next, it is judged whether or not the setting confirmation key 607 is depressed (S5). By this setting, it is possible to judge whether or not the presentation mode setting is confirmed and the setting is again performed. If judged that the presentation mode setting is confirmed and the setting is again performed, the flow advances to the step S8 to confirm the presentation mode setting and again perform the setting.

On the other hand, if judged that the setting confirmation key 607 is not depressed, and when the necessary number of distribution copies and the like are input and the copy start key 82 is then depressed (S6), the copying process according to the presentation mode setting is performed to the OHP sheet and the ordinary sheet (S7), and the process ends.

When the OK key 703 on the OHP copy setting screen shown in FIG. 5A is depressed in the step S9, it is judged whether or not the original information setting (input) was performed in the distribution copy setting shown in FIGS. 6A to 6F (S11). If judged that the original information setting (input) is not yet performed in the distribution copy setting, the original information setting screen shown in FIG. 5B is displayed in the state that any option buttons (the one-faced original key 705 and the two-faced original key 706) for inputting the original information is not yet selected, and the flow advances to the step S14.

Next, in the step S14, when the original information is input (i.e., the one-faced original key 705 or the two-faced original key 706 is selected) and the OK key is depressed, the setting for this original information is stored in the nonvolatile memory 501*d*, the RAM 501*b* or the like shown in FIG. 2, and the flow advances to the step S13. Conversely, when the distribution copy setting key 702 is depressed (S17), the setting till then is stored in the nonvolatile memory 501*d*, the RAM 501*b* or the like shown in FIG. 2, and the flow advances to the step S18 shown in FIG. 9.

On the other hand, if judged in the step S11 that the original information has been already input in the distribution copy setting mode of FIGS. 6A to 6F, the original information setting screen shown in FIG. 5B is displayed in the state that the option button has been selected according to the original information (stored in the nonvolatile memory 501*d*, the RAM 501*b* or the like shown in FIG. 2) input in the distribution copy setting mode (i.e., corresponding to the shading shown in FIG. 5B), and the flow advances to the step S12.

Next, in the step S12, if the original information is reset by the user (i.e., the original information setting is again performed), the flow advances to the step S14. Conversely, if the original information is not reset, the OK key 707 is depressed as it is by the user, and the flow advances to the step S13.

Next, in the step S13, the inserting paper setting screen shown in FIG. 5C is displayed.

In the step S13, the inserting paper copy setting is judged. Namely, if judged that the OK key 712 is depressed in a no inserting paper copy state (i.e., the state that the no inserting paper key 709 is selected), this setting is stored in the nonvolatile memory 501*d*, the RAM 501*b* or the like shown in FIG. 2, and the flow directly advances to the step S15.

If judged in the step S13 that the OK key 712 is depressed in a white inserting paper state (i.e., the state that the white inserting paper key 710 is selected), this setting is stored in the nonvolatile memory 501*d*, the RAM 501*b* or the like shown in FIG. 2, and the sheet feed cassette selection screen shown in FIG. 5D is displayed to accept the inserting paper cassette selection. Then, this setting is stored in the nonvolatile memory 501*d*, the RAM 501*b* or the like shown in FIG. 2, and the flow advances to the step S15.

Further, if judged in the step S13 that the OK key 712 is depressed in an inserting paper copying state (i.e., the state that the inserting paper copy key 711 is selected), this setting is stored in the nonvolatile memory 501*d*, the RAM 501*b* or the like shown in FIG. 2, and the sheet feed cassette selection screen shown in FIG. 5D is displayed to accept the inserting paper cassette selection. Then, if the OK key 718 is depressed, this setting is stored in the nonvolatile memory 501*d*, the RAM 501*b* or the like shown in FIG. 2, and the flow advances to the step S15. On the other hand, if the distribution copy setting key 702 is depressed (S17), the setting till then is stored in the nonvolatile memory 501*d*, the RAM 501*b* or the like shown in FIG. 2, and the flow advances to the step S18 shown in FIG. 9.

Next, in the step S15, the OHP copy number setting screen shown in FIG. 5E is displayed, the necessary number of copies is input, and the OK key 723 is depressed. This setting is stored in the nonvolatile memory 501*d*, the RAM 501*b* or the like shown in FIG. 2, and the flow advances to the step S16. On the other hand, if the distribution copy setting key 702 is depressed (S17), the setting till then is stored in the nonvolatile memory 501*d*, the RAM 501*b* or the like shown in FIG. 2, and the flow advances to the step S18 shown in FIG. 9.

Next, in the step S16, it is judged whether or not the distribution copy setting ended. If judged that the distribution copy setting ended, the flow returns to the step S3 in FIG. 7, and the screen is changed to the copy standby screen in the presentation mode shown in FIG. 4C.

On the other hand, if judged in the step S16 that the distribution copy setting does not end, the flow advances to the step S18 shown in FIG. 9 to enter the distribution copy setting mode.

If the OK key 803 on the distribution copy setting screen shown in FIG. 6A is depressed in the step S10, it is judged whether or not the original information setting (input) was performed in the OHP copy setting (S18). If judged that the original information setting (input) is not yet performed in the OHP copy setting, the original information setting screen shown in FIG. 6B is displayed in the state that any option buttons (the one-faced original key 805 and the two-faced original key 806) for inputting the original information is not yet selected, and the flow advances to the step S21.

Next, in the step S21, when the original information is input (i.e., the one-faced original key 805 or the two-faced original key 806 is selected) and the OK key is depressed, the setting for this original information is stored in the nonvolatile memory 501*d*, the RAM 501*b* or the like shown in FIG. 2, and the flow advances to the step S20. Conversely, when the OHP copy setting key 802 is depressed (S23), the flow advances to the step S11 shown in FIG. 8 to enter the OHP copy setting mode.

On the other hand, if judged in the step S18 that the original information has been already input in the OHP copy setting mode of FIGS. 5A to 5E, the original information setting screen shown in FIG. 6B is displayed in the state that the option button has been selected according to the original information (stored in the nonvolatile memory 501*d*, the RAM 501*b* or the like shown in FIG. 2) input in the OHP copy setting mode (i.e., corresponding to the shading shown in FIG. 5B), and the flow advances to the step S19.

Next, in the step S19, if the original information is reset by the user (i.e., the original information setting is again performed), the flow advances to the step S21. Conversely, if the original information is not reset, the OK key 707 is depressed as it is by the user, and the flow advances to the step S20.

Next, in the step S20, when the original information setting is directed to the one-faced copying, the one-faced copy setting screen shown in FIG. 6C is displayed. When the original information setting is directed to the two-faced copying, the two-faced copy setting screen shown in FIG. 6D is displayed.

Next, in the step S20, the copy (distribution copy) setting for the ordinary sheet is judged.

In the step S20, if it is judged that the copy (distribution copy) setting for the ordinary sheet is directed to the one-faced original to one-faced copying (i.e., the one-faced original to one-faced copy key 810 is selected), the one-faced original to two-faced copying (i.e., the one-faced original to two-faced copy key 811 is selected), the two-faced original to two-faced copying (i.e., the two-faced original to two-faced copy key 816 is selected), or the two-faced original to one-faced copying (i.e., the two-faced original to one-faced copy key 817 is selected), and the OK key 813 or 819 is depressed, then this setting is stored in the nonvolatile memory 501*d*, the RAM 501*b* or the like shown in FIG. 2, and the flow directly advances to the step S22.

On the other hand, if judged in the step S20 that the OHP copy setting key 802 is depressed (S23), the setting till then is stored in the nonvolatile memory 501*d*, the RAM 501*b* or the like shown in FIG. 2, and the flow advances to the step S11 shown in FIG. 8.

Next, in the step S22, it is judged whether or not the OHP copy setting ended. If judged that the OHP copy setting already ended, the flow returns to the step S3 in FIG. 7, and the screen is changed to the copy standby screen in the presentation mode shown in FIG. 4C.

On the other hand, if judged in the step S22 that the setting does not end, the flow advances to the step S11 shown in FIG. 8 to enter the OHP copy setting mode.

As above, in the presentation mode setting, it is possible to start from either of the OHP sheet copy setting and the ordinary sheet copy setting, and it is possible to change, while one setting is being performed, one setting mode to the other setting mode. Thus, since it is possible to omit an extra setting procedure for the OHP or ordinary sheet setting or the change of the setting, operability increases.

Further, if the part (e.g., the original information) of the setting information is shared in both the OHP sheet and ordinary sheet copy setting modes, resetting of the setting information becomes unnecessary, whereby operability increases.

Therefore, since it is possible to start the copy setting from either of the copy setting for the first kind of sheet (the OHP sheet) and the copy setting for the second kind of sheet (the ordinary sheet), and it is possible to freely change, while the copy setting for one sheet (the distribution copy setting key 702 or the OHP copy setting key 802) is being performed, the copy setting for the one sheet to the copy setting for the other sheet, the operability in the copying operation increases. Further, since it is possible to share the information (e.g., the original information) with both the OHP sheet copy setting and the ordinary sheet copy setting, the operability also increases.

Second Embodiment

When the presentation is performed, there is a case where it is intended to perform color copying on the OHP sheet for use of the OHP, perform color copying on a high-quality sheet such as a glossy sheet, a cardboard or the like for distribution to clients, and produce material by monochrome copying on an ordinary sheet for distribution to own staffs. Hereinafter, the structure of an image formation apparatus which satisfies such a demand as above by a simple operation according to the present embodiment will be explained.

In the above first embodiment, in the presentation mode that the same image is formed on both the OHP sheet and the ordinary sheet, the case where the setting information for the image formation on each recording medium (the OHP sheet, the ordinary sheet) is input was explained. However, the recording medium is not limited only to the OHP sheet and the ordinary sheet. For example, it is possible to set a copying mode that the same image is formed on all of the plural different kinds of recording media such as the OHP sheet, the ordinary sheet, the glossy sheet, the cardboard and the like, and individually input the setting information for the image formation on each recording medium.

In this case, on the presentation mode setting screen shown in FIG. 4B, not only the OHP copy setting key 603 and the distribution copy setting key 604 but also the copy setting keys for all of the plural different kinds of recording media are displayed to enable to start the setting input from any setting information for the image formation on any recording medium.

Further, like the OHP copy setting screen and the distribution copy setting screen shown in FIGS. 5A to 5E and 6A to 6D, the setting screen corresponding to each kind of recording medium is provided. Further, like the distribution copy setting key 702 and the OHP copy setting key 802, the setting keys corresponding to the plural kinds of recording media are provided on each setting screen. Thus, even if the setting information is being input on the setting screen for which kind of recording medium, it is possible to store the information being input for the setting in the nonvolatile memory 501*d* or the like and also change the setting screen being displayed to the setting screen for any other kind of recording medium.

Further, a setting key for selecting either of color image formation and monochrome image formation is provided of each setting screen. Thus, it is possible to independently set color copying or monochrome copying for each of the plural kinds of recording media.

Further, even if the copy setting is being performed for which kind of recording medium, it is possible to share the part of the setting information such as original information or the like.

By the above structure, it is possible to start the copy setting for the plural different kinds of recording media from the copy setting for which kind of recording medium, and further it is possible to freely change, while the copy setting for which kind of recording medium is being performed, such the copy setting to the copy setting for the other recording medium. Thus, it is possible by an extremely simple operation to produce the material in which the color copying is performed on the OHP sheet, the glossy sheet, the cardboard and the like and the monochrome copying is performed on the ordinary sheet.

Further, even if the copy setting is being performed for which kind of recording medium, it is possible to share the part of the setting information (e.g., the original information), whereby operability further increases.

Third Embodiment

In the above second embodiment, the setting information for the image formation on each recording medium is input for all of the plural different kinds of recording media such as the OHP sheet, the ordinary sheet, the glossy sheet, the cardboard and the like. However, in a case where the original image is formed on a specific kind of recording medium (e.g., the OHP sheet) among the plural different kinds of recording media, it is possible to perform one determined image formation process (e.g., the original information depending on the setting for other recording medium, the white inserting paper, the inserting paper feed cassette A4, and the number of copies "1").

It should be noted that the image formation apparatus according to the present invention may adopt an electrophotographic method, an inkjet method, a sublimation method, a thermal transfer method, and other method.

Further, in the first to third embodiments, the case where the original image read by the image reading unit 3 is formed respectively on the plural different recording media was explained. However, it is possible to provide an interface capable of communicating with an external apparatus such as a computer or the like to form an image transmitted from the external apparatus on the plural different recording media.

In this case, it is possible not to perform the original information setting shown in FIGS. 5B and 6B, and it is possible to merely select other copying such as one-faced copying, two-faced copying, 2-in-1 copying and the like as the one-faced copy setting information shown in FIG. 6C and the two-faced copy setting shown in FIG. 6D.

Hereinafter, the structure of data process programs readable by the image formation apparatus according to the present invention will be explained with reference to a memory map shown in FIG. 10.

FIG. 10 is the diagram for explaining the memory map of a storage medium in which the data process programs readable by the image formation apparatus according to the present invention.

It should be noted that, though not shown in FIG. 10, information such as version information, a creator and the like which manages a program group stored in the storage medium is also stored in the medium. Further, information such as an icon for discriminatively displaying a program and the like which depends on an OS or the like on the program reading side might be stored in the medium.

Further, data depending on various programs are managed as the directory information in the storage medium. Further, in a case where programs to be installed and data have been compressed, a program or the like used to decompress these programs and data might be stored.

The functions shown in FIGS. 7 to 9 in the embodiment might be executed by a host computer based on a program externally installed. In this case, the present invention is applicable to a case where a group of the information including the program is supplied to an output apparatus from a storage medium such as a CD-ROM, a flash memory, a floppy disk (FD) or the like, or from an external storage medium through a network.

As above, it is needless to say that the object of the present invention can be attained in a case where a storage medium recording program codes of software to realize the functions of the above embodiments is supplied to a system or apparatus, and a computer (or CPU or MPU) in this system or apparatus reads and executes the stored program codes.

In this case, the program codes themselves read from the storage medium execute new functions of the present invention, whereby the storage medium storing these program codes constitutes the present invention.

As the storage medium from which the program codes are supplied, for example, a floppy disk, a hard disk, an optical disk, a magnetooptical disk, a CD-ROM, a CD-R, a magnetic tape, a nonvolatile memory card, a ROM, an EEPROM, a silicon disk, or the like can be used.

Further, it is needless to say that the present invention includes not only the case where the functions of the above embodiments are executed by the program codes read by the computer, but also a case where an OS (operating system) or the like running on the computer executes a part or all of the actual processes based on instructions of the program codes and thus the functions of the above embodiments are executed by such the processes.

Further, it is needless to say that the present invention includes a case where the program codes read from the storage medium are once stored in a memory provided in a function expansion board inserted in the computer or a function expansion unit connected to the computer, and then a CPU or the like provided in the function expansion board or the function expansion unit performs all or a part of the actual processes based on instructions of the program codes, whereby the functions of the above embodiments are achieved by such the processes.

Further, the present invention is applicable to a system structured by plural equipments or to an apparatus structured by one equipment. Further, it is needless to say that the present invention is applicable to a case where programs are supplied to the system or apparatus. In this case, when the storage medium storing the programs represented by the software to attain the present invention is subjected to reading by the system or apparatus, this system or apparatus can enjoy the effects of the present invention.

Further, when the programs represented by the software to attain the present invention are downloaded from a data base on a network and read according to a communication program, the system or apparatus can enjoy the effects of the present invention.

As explained above, when the copying mode to form the same original image on all the plural different kinds of recording media is set by the copying mode setting means, it is selected by the selection means which of the plural different kinds of recording media the setting input for the image formation should be performed to, the plural setting screens provided corresponding to the respective kinds of recording media are displayed on the display unit by the display means: the setting screen is used to input the setting information for the image formation to the recording medium of which kind was selected by the selection means, the setting information is input by the input means from the setting screen displayed on the display unit, the setting information input from the setting screen is stored in the storage means, and then the information being subjected to the setting input is stored in the storage means and the setting screen is changed to the setting screen corresponding to the other kind of recording medium by the change means even if the setting information from the setting screen corresponding to the selected kind of recording medium is being input. Thus, in the case where the presentation mode to form the same original image on all of the plural different kinds of recording media including the OHP sheet and the ordinary sheet is being set, it is possible to start the image formation setting for the plural different kinds of recording media from the image formation setting for which kind of recording medium. Further, even if the image formation setting is being performed for which kind of recording medium, it is possible to freely change such the state to the state capable of inputting the image formation setting for any other kind of recording medium, whereby the setting of the presentation mode can be easily performed.

Further, the part of the setting information which is input from the setting screen corresponding to the selected kind of recording medium, stored in the storage means, and used to form the image on such the recording medium can be shared as the setting information to form the image on the other kind of recording medium. Thus, it is unnecessary to again perform the setting when one setting information is used in the copy setting for the different kind of recording medium, whereby operability further increases.

Further, the sharable part of the setting information includes the original information for setting whether the original is the one-faced original or the two-faced original. Thus, it is unnecessary to again perform the setting for the original information shared in the image formation to which kind of recording medium when one setting information is used in the copy setting for the different kind of recording medium, whereby operability further increases.

Further, when the original image is formed on the specific kind of recording medium among the plural different kinds of recording media, it is possible to perform one determined image formation process. Thus, it is possible to perform the setting for the presentation mode or the like by performing only the setting for the image formation on the other kind of recording medium, whereby operability further increases.

Further, when the copying mode to form the same original image on all the plural different kinds of recording media is set, it is selected which of the plural different kinds of recording media the setting input for the image formation should be performed to, the plural setting screens provided corresponding to the respective kinds of recording media are displayed on the display unit: the setting screen is used to input the setting information for the image formation to the selected kind of recording medium, the setting information is input from the setting screen displayed on the display unit, the setting information input from the setting screen is stored in the memory resource, and then the information being subjected to the setting input is stored in the memory resource and the setting screen is changed to the setting screen corresponding to the other kind of recording medium even if the setting information from the setting screen corresponding to the selected kind of recording medium is being input. Thus, in the case where the presentation mode to form the same original image on all of the plural different kinds of recording media including the OHP sheet and the ordinary sheet is being set, it is possible to start the image formation setting for the plural different kinds of recording media from the image formation setting for which kind of recording medium. Further, even if the image formation setting is being performed for which kind of recording medium, it is possible to freely change such the state to the state capable of inputting the image formation setting for any other kind of recording medium, whereby the setting of the presentation mode can be easily performed.

Therefore, in the case where the presentation mode to form the same original image on all of the plural different kinds of recording media including the OHP sheet and the ordinary sheet is being set, it is possible to omit an extra setting procedure for the setting for the plural different kinds of recording media and the change of such the setting, it is possible to provide an excellent presentation mode setting environment capable of starting the setting from the setting for which kind of recording medium.

What is claimed is:

1. A storage medium storing a computer-executable program for controlling an image formation apparatus, the apparatus including a function to set a disparate media mode to form an image on plural different kinds of recording media, the program comprising:

code for changeably displaying plural setting screens corresponding to the plural different kinds of recording media, respectively, each setting screen being used to input setting information concerning image formation on a respective one of the plural different kinds of recording media;

code for inputting setting information from a setting screen;

code for storing the inputted setting information; and code for changing a setting screen corresponding to one kind of recording medium to a setting screen corresponding to another kind of recording medium according to a predetermined indication.

2. A storage medium according to claim 1, wherein the program further comprises:

code for displaying an indication area on the plural setting screens; and code for changing a setting screen corresponding to one kind of recording medium to a setting screen corresponding to another kind of recording medium according to an action taken with respect to the indication area.

3. A storage medium according to claim 2, wherein the program further comprises code for, when the disparate media mode is set, changing, even if the inputting of the setting information from the setting screen corresponding to the one kind of recording medium has not ended, the setting screen to a setting screen corresponding to another kind of recording medium, according to the action taken with respect to the indication area.

4. A storage medium according to claim 2, wherein the program further comprises code for always displaying the indication area when each of the respective setting screens corresponding to the plural kinds of recording media is displayed.

5. A storage medium according to claim 1, wherein a part of the setting information, which is input from the setting screen corresponding to the one kind of recording medium and used for image formation on the recording medium, is shared as setting information for image formation on another kind of recording medium.

6. A storage medium according to claim 1, wherein, when the image is formed on a specific kind of recording medium among the plural different kinds of recording media, a predetermined image formation process is performed.

7. A storage medium according to claim 1, wherein the plural different kinds of recording media include an OHP sheet and an ordinary sheet.

8. A storage medium according to claim 7, wherein setting information for image formation on the ordinary sheet includes copy number setting information for setting a number of copies of the image to be formed on the ordinary sheet.

9. A storage medium according to claim 7, wherein setting information for image formation on the OHP sheet includes copy number setting information for setting a number of copies of the image to be formed on the OHP sheet.

* * * * *

UNITED STATES PATENT AND TRADEMARK OFFICE

CERTIFICATE OF CORRECTION

PATENT NO. : 6,473,575 B2
DATED : October 29, 2002
INVENTOR(S) : Satoshi Okawa et al.

It is certified that error appears in the above-identified patent and that said Letters Patent is hereby corrected as shown below:

Column 2,
Line 34, "control." should read -- control --.

Signed and Sealed this

Eighth Day of April, 2003

JAMES E. ROGAN
*Director of the United States Patent and Trademark Office*